United States Patent [19]

Egli

[11] 4,108,384

[45] Aug. 22, 1978

[54] CENTRIFUGAL SLINGING APPARATUS FOR HOT REPAIR OF ELECTRIC FURNACES, LADLES OR THE LIKE

[75] Inventor: Ernst Egli, Dietikon, Switzerland

[73] Assignee: Spribag Aktiengesellschaft, Widen-Mutschellen, Switzerland

[21] Appl. No.: 745,399

[22] Filed: Nov. 26, 1976

[30] Foreign Application Priority Data

Nov. 27, 1975 [CH] Switzerland ..... 15415/75

[51] Int. Cl.[2] ..... F27D 1/16

[52] U.S. Cl. ..... 239/665; 239/683; 239/689; 118/317; 264/30; 266/281

[58] Field of Search ..... 294/81 R, 85; 239/665, 239/683, 689, 224; 118/306, 317; 264/30; 266/281, 287

[56] References Cited

U.S. PATENT DOCUMENTS

| | | | |
|---|---|---|---|
| 1,166,476 | 1/1916 | Parrish | 239/665 |
| 1,339,256 | 5/1920 | Browning | 239/689 |
| 2,877,974 | 3/1959 | Estes | 294/85 X |
| 3,210,085 | 10/1965 | Rastak et al. | 239/665 |
| 3,760,933 | 9/1973 | Maldels et al. | 239/665 |
| 3,865,422 | 2/1975 | Archer | 294/81 R |

FOREIGN PATENT DOCUMENTS

| | | | |
|---|---|---|---|
| 1,217,414 | 5/1966 | Fed. Rep. of Germany | 266/281 |

*Primary Examiner*—Robert W. Saifer

*Attorney, Agent, or Firm*—James E. Nilles

[57] ABSTRACT

Apparatus for repairing electric furnaces, ladles or the like while they are hot and which includes a centrifugal slinging machine that can be lowered into the hot furnace. The machine includes a centrifuging wheel which can deliver lining repair material radially outwardly and against the interior wall of the furnace. The centrifugal delivery portion of the machine can be selectively divided into sectors so that repair material can be selectively dispersed only against that portion of the interior furnace wall that needs repair or alternatively, the machine can deliver material to the entire circumference of the interior of the furnace. The machine has adjustable sliders which are provided around the circumference of the machine to selectively distribute the material around the interior of the furnace and the sliders are infinitely variable in their adjustment, and radial director vanes act in cooperation with the sliders. The machine also has a mixing worm vertically above the centrifuging wheel and located in the bottom of the material supply hopper. An upwardly tapering and stepless supporting cone is located in the hopper and is also vertically adjustable so as to form a variable annular clearance with the upwardly diverging hopper. An automatic clamping device is provided for selectively securing the machine on a supporting arm, whereby the machine can be quickly and easily adjusted in a variety of positions.

12 Claims, 9 Drawing Figures

CENTRIFUGAL SLINGING APPARATUS FOR HOT REPAIR OF ELECTRIC FURNACES, LADLES OR THE LIKE

BACKGROUND OF THE INVENTION

The invention pertains generally to an apparatus for hot repair of electric furnaces and ladles, which directs refractory material radially to a damaged lining location in the furnace wall. The apparatus has a vertically adjustable centrifuging machine that can be suspended centrally in the interior of the furnace chamber. These machines have a centrifuging wheel that is supported essentially in a horizontal plane and to which wheel the refractory material is fed from a hopper located above the wheel.

Prior art apparatus have proposed such centrifuging machines in which wetted refractory material is conducted to a centrifuging plate and is centrifuged radially against the furnace wall.

Repair apparatus of the above-described type must be lowered into the hot furnace to be repaired and therefore the apparatus must move extremely fast so that the machine will not get extremely hot and also to insure that its operation is not compromised. Furthermore, the damaged part of the furnace must be repaired, but insofar as possible, only that damaged part should be repaired to prevent unnecessary use of repair material.

The amount of material that is centrifuged off of the centrifuging wheel in each passage through the open sector must be adjustable easily and to appropriate limits such that the layer thickness is optimal, so that the total manipulation time is short enough and still provide a sufficiently thick layer and the quality of the repair, i.e., many thin layers, is high.

SUMMARY OF THE INVENTION

The present invention provides centrifugal slinging apparatus for the hot repair of electric furnaces, ladles, or the like which accomplish the above-desired functions. The apparatus includes a metering device which can be installed and adjusted shortly before its movement into the furnace to be repaired, to repair damaged areas in the furnace taking into consideration all dimensions of the damaged location, which metering device also provides an optimum scattering angle around the furnace.

The present apparatus has a centrifuging wheel including a central, cylindrical chamber subdivided in the form of radial upwardly opening sectors which can be wholly or partly opened or closed by means of vertically shiftable metering sliders that can be adjusted independently of one another.

These and other objects and advantages of the present invention will appear hereinafter as this disclosure progresses, reference being had to the accompanying drawings.

DESCRIPTION OF A PREFERRED EMBODIMENT

Figure 2:
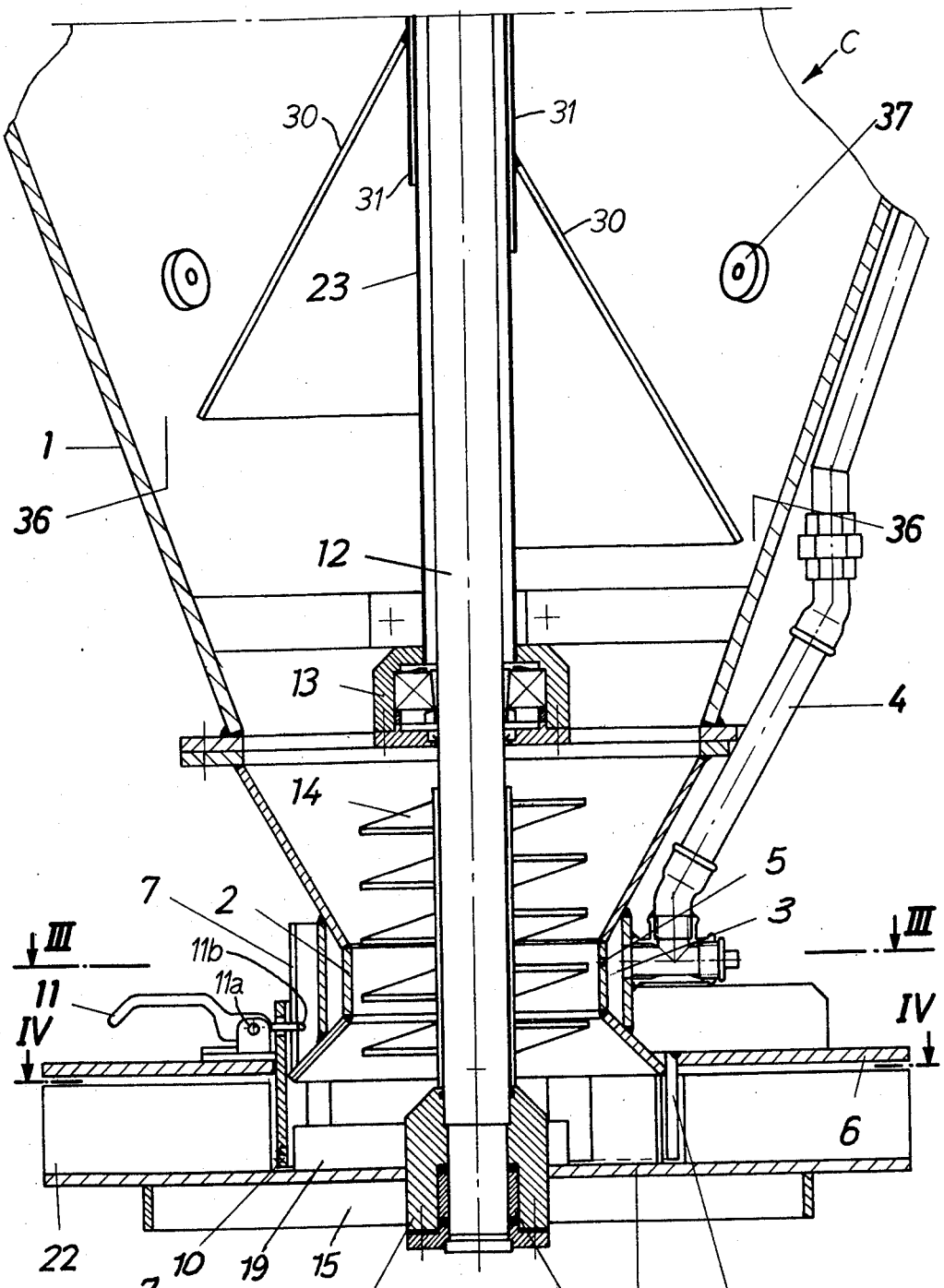
FIG. 2 is an enlarged, detailed, cross-sectional view of a portion of the centrifuge shown in the lower portion of FIG. 1, with the vertical slide plates and the centrifuging wheel.
Figure 3:
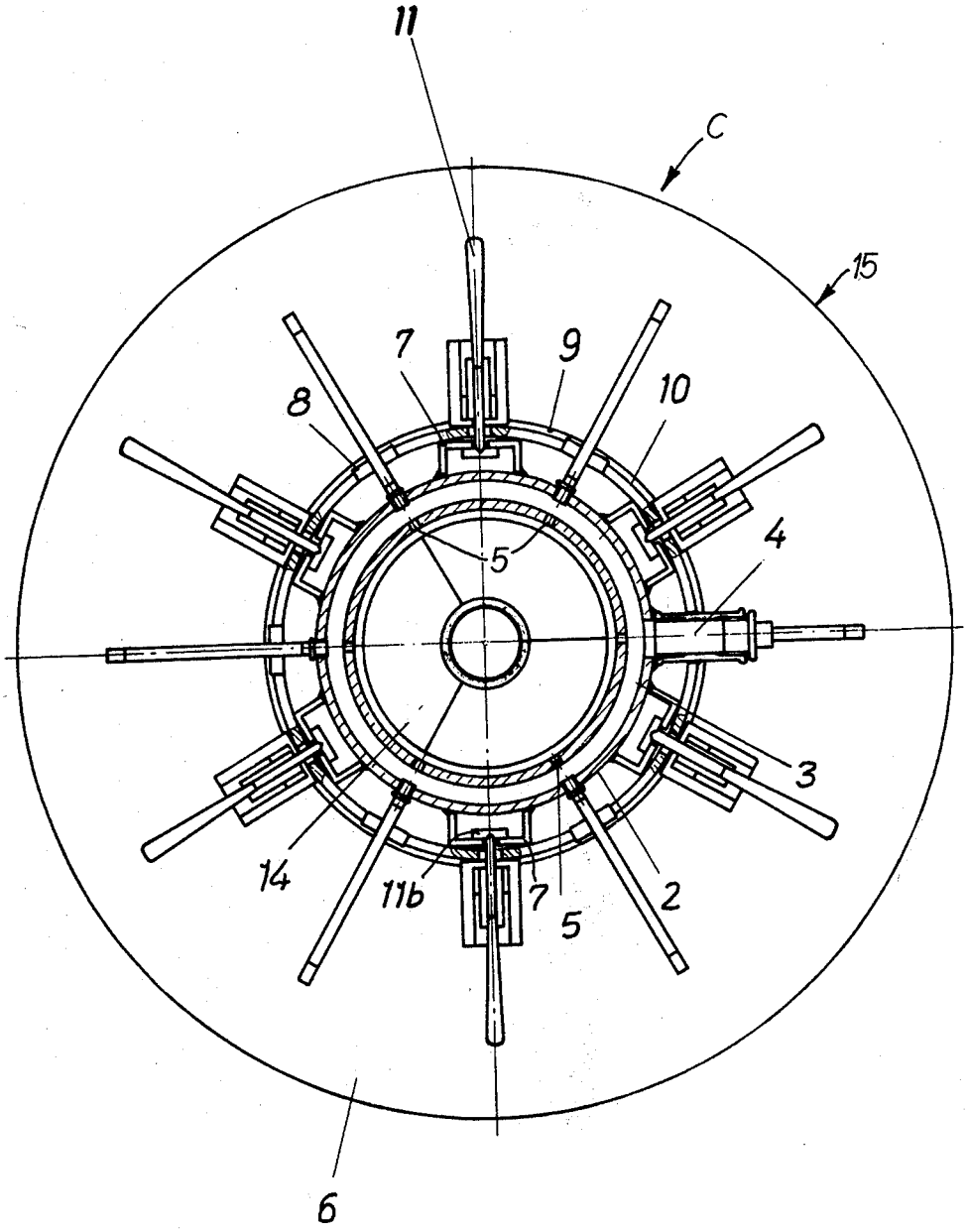
FIG. 3 is a horizontal, sectional view taken along the line III—III in FIG. 2.
Figure 4:
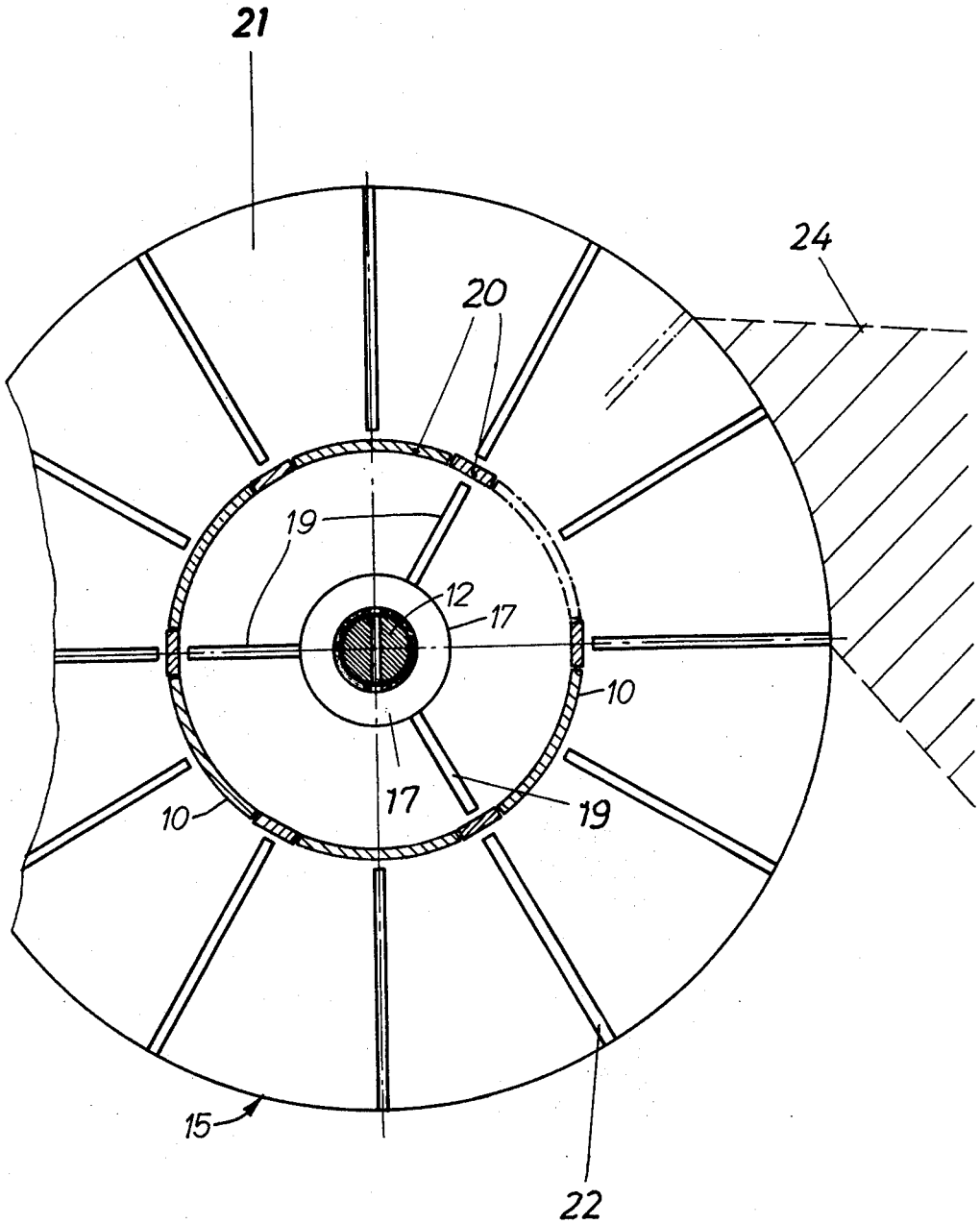
FIG. 4 is a horizontal, sectional view taken along the line IV—IV in FIG. 2.
Figure 5:
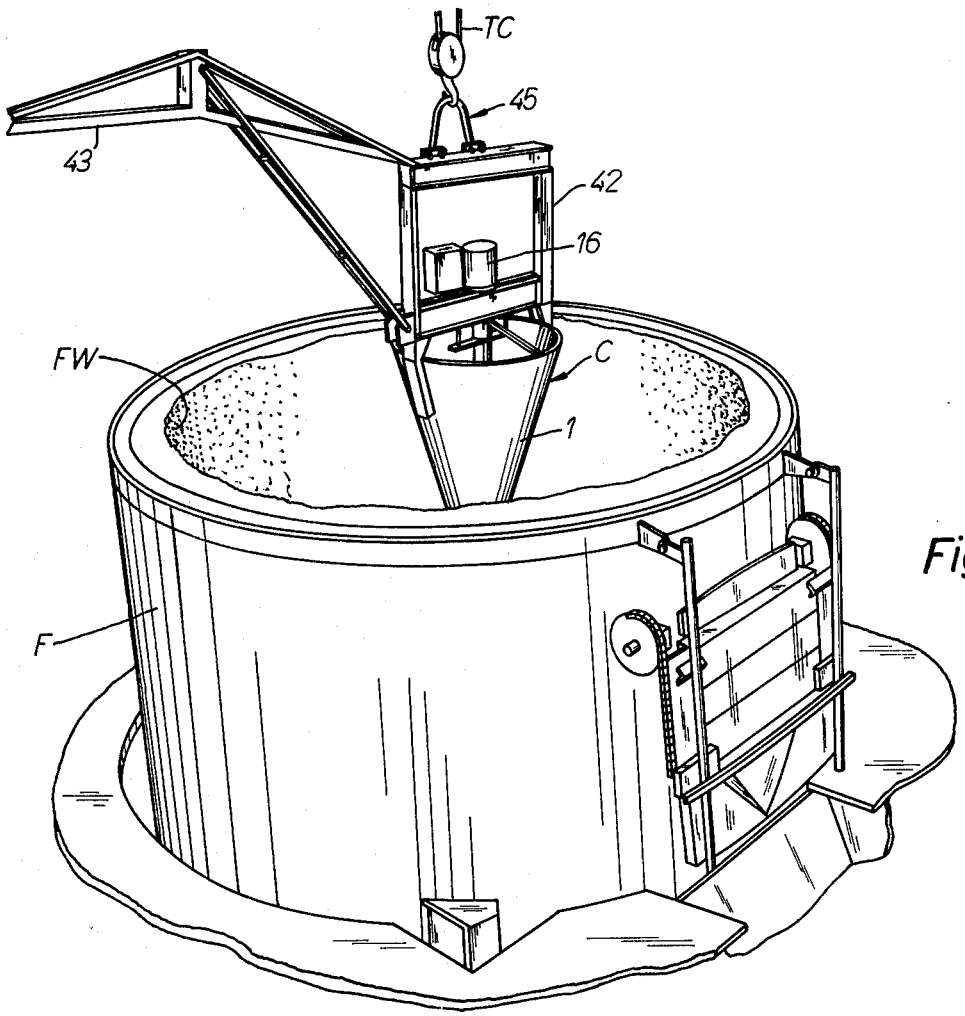
FIG. 5 is a general perspective view on a somewhat reduced scale and showing the centrifuge of the present invention as supported over the furnace which is to be repaired.
Figure 6:
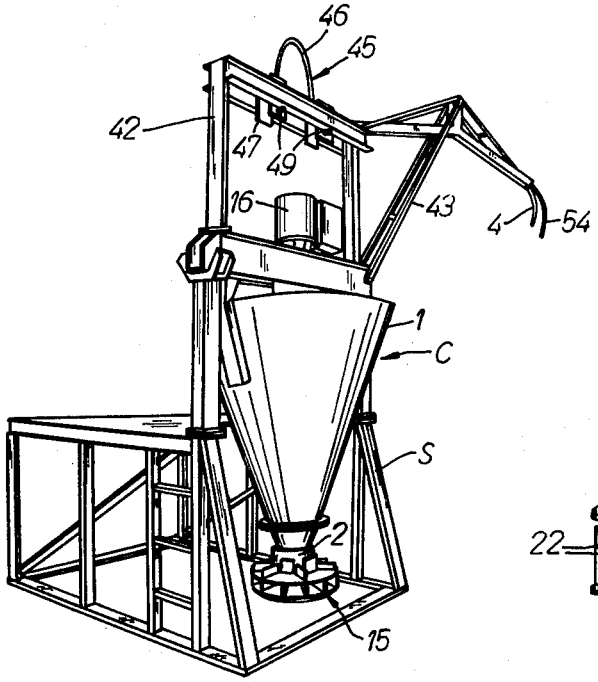
FIG. 6 is a perspective view of the centrifuge when it is located in its special charging stand where it is filled with repair material.

The sector centrifuge C comprises a hopper 1 which is movably supported at its upper end on a suspension frame 42 carried at the free end of a boom 43. A circular mixing duct 2 is secured as by welding to the lower end of the hopper. This mixing duct 2 comprises an annular ring-shaped water chamber 3 with a supply pipe 4 and, for example, six injection nozzles 5 which are circumferentially spaced apart. The centrifuge also includes a centrifuging wheel cover 6. Clamping brackets or angles 7 are welded to the duct 2, as shown in FIGS. 2 and 3.

A central drive shaft 12 is supported in the vertically spaced bearings 13. Secured adjacent the lower end of the drive shaft 12 is a mixing worm 14, and a centrifuging wheel 15 is secured to the lower end of shaft 12. A drive motor 16, for example, a compressed air motor, is connected to the upper end of the shaft for driving the latter to impart to the centrifuging wheel 15 a rotation of 800 – 1000 revolutions per minute.

Figure 2A:
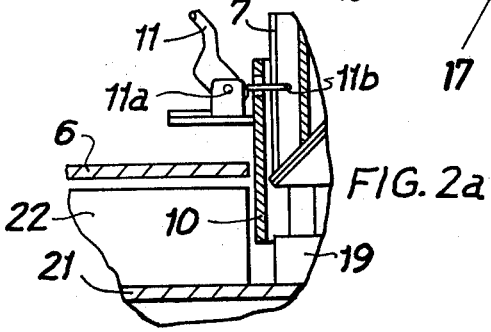
FIG. 2*a* is a fragmentary view of a portion of the device shown in FIG. 2, but showing the lever in the raised, unclamped position.
Figure 7:
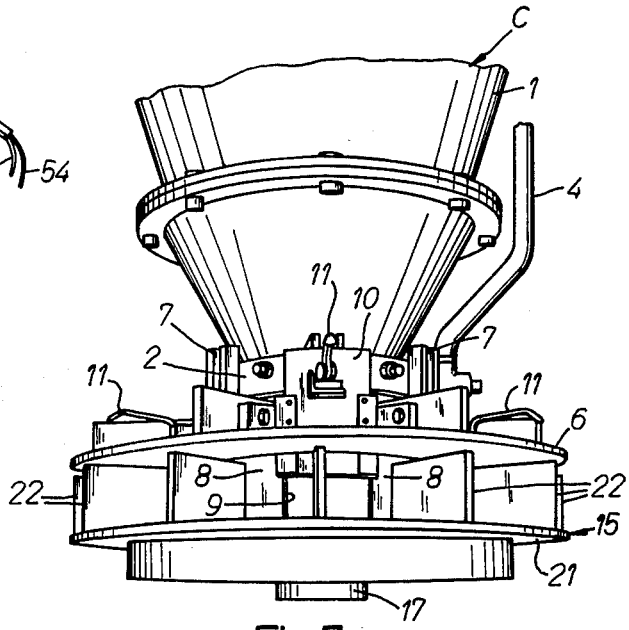
FIG. 7 is a perspective view of the lower end of the centrifuge which is shown in FIGS. 1 and 2.

Between the mixing duct 2 and the centrifuging wheel cover 6 there are six curved slots 9 which are defined by the easily replaceable suitable slider guides 8. In these curved slots 9, six correspondingly curved vertical sliders 10 are clamped to the clamping angles 7 with rapidly closing toggle joints or levers 11 eccentrically pivoted at 11*a* and resting on the cover 6 when slider 10 is in the closed position shown in FIG. 2. Levers 11 have radially inner ends 11*b* (FIGS. 2 and 3) that extend through their respective sliders 10 and these inner ends 11*b* clamp against the inside of angles 7, as shown in FIGS. 2 and 3 when levers 11 are in the clamping position shown. FIG. 2*a* shows the lever 11 in the unclamped position. In this manner, the sliders are each vertically lifted by their lever 11 against gravity and steplessly adjustable to vary the amount of material which is permitted to pass through the slots 9. FIG. 7 shows one of the sliders 10 and its associated lever 11 in the raised position above cover 6. The vertical gates or sliders 10 then extend downwardly into the centrifuging wheel 15 between and along with their respective pair of slider guides 8.

The centrifuging wheel 15 has a hub 17 (FIG. 2) fixed thereto and has a clamped securement 18 to the lower end of the drive shaft 12. Three driving ribs 19 extend ray-like outwardly from hub 17 and toward a closure ring 20 which is formed by the vertical slide plates 10 and the slide guides 8. The three, vertically positioned driving ribs 19 are secured to the hub 17 and to a centrifuging wheel plate 21 which forms the bottom of the wheel 15, as by welding. On the outer side of the closure ring 20 and also secured as by welding for example, to the centrifuging wheel bottom plate 21, are twelve limiting ribs or vanes 22 which are radially extending and which direct the centrifuged material that has been allowed to pass through the vertical slide plates 10.

Figures 1, 8:
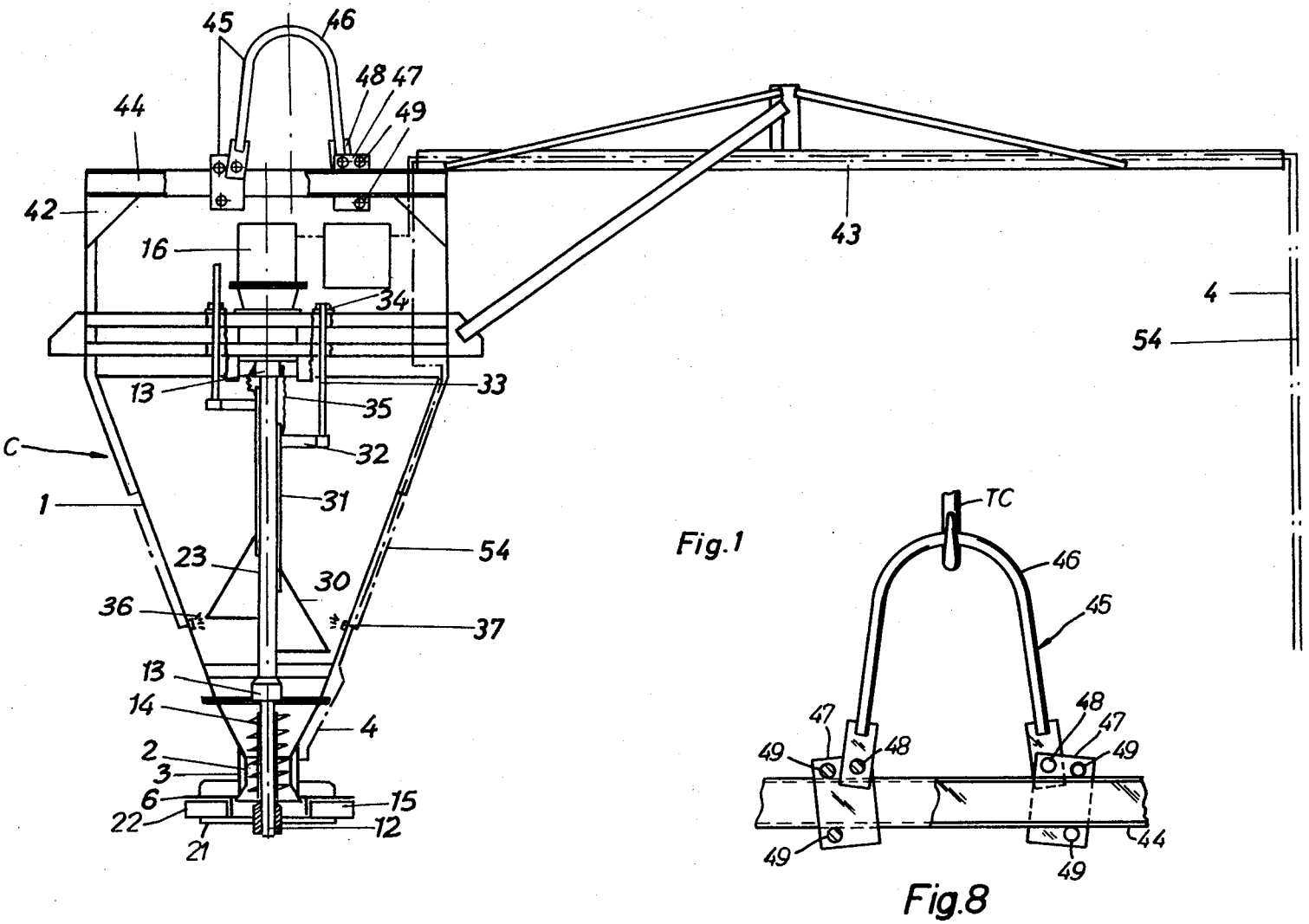
FIG. 1 is a vertical sectional view of a sector centrifuge, the supporting cone being shown in two different positions.
FIG. 8 is an enlarged view of the automatic clamping device shown in FIG. 1.

The vertically spaced bearings 13 of the drive shaft 12 are connected together by a pipe 23, which surrounds the shaft 12. A supporting cone 30, which has an upwardly converging taper, is secured to a vertically shiftable pipe 31, can be adjusted in height by means of threaded rods 33 (FIG. 1) and nuts 34 secured to two arms 21. At its upper end, the adjusting pipe 31 is sealed from the bearing 13 with a flexible packing ring 35. In this manner, a variable annular clearance 36 is provided between the supporting cone 30 and the upwardly diverging inner wall of the hopper 1, and the flow-through of the refractory material can thereby be coarsely metered.

The suspension frame 42 for the slinging machine is provided, on an upper cross bar 44, with a suspension arrangement 45 consisting of an inverted U-shaped clevis hook 46 and two clamping parts 47. The clevis hook 46 is movably secured along bar 44 by the two clamping parts 47. More specifically, the lower ends of the hook are pivoted to parts 47 by means of carrying or pivot pins 48, so that both clamping pins 49, one located on each side of the bar 44, when the hook 46 is raised, the parts 47 pivot and the pins 49 automatically clamp against opposite sides of the bar 44 (FIG. 8) due to force reaction on the clevis hook 46 when lifting of the sector centrifuge occurs. In this way, the unloaded suspension fixture 45 (FIG. 1) can be pushed freely on the upper cross bar 44, but upon the lifting of the sector centrifuge (FIG. 8), it automatically clamps itself tight.

Operation

In a special stand S, the sector centrifuge is charged with refractory material according to the anticipated repair. The supporting cone 30 is adjusted according to the anticipated discharge output. Finally, with the help of the travelling crane TC acting on the suspension device 45, the sector centrifuge is brought into plumb. Thereupon the sector centrifuge is positioned in the vicinity of the furnace F and is connected up the water duct 4 and the compressed air line 54. The sectors 24 in which refractory material is to be charged are fixed and then the corresponding vertical sliders 10 are opened according to the furnace diameter and the depth of the location in the furnace lining that is to be repaired. The sector centrifuge, thus prepared, is now lowered and run into the furnace and secured at the proper height. The water duct 4 and compressed air line 54 are then opened, and the drive motor begins to turn the centrifuging wheel 15 and the mixing worm 14. The refractory material flows through the annular clearance 36 in the mixing duct 2, is mixed by means of the mixing worm 14 with the water that enters through the injection nozzles 5, and arrives at the inner part of the centrifuging wheel 15. There, by means of the driving ribs 19, the material is carried to the outer part of the centrifuging wheel 15, under the more or less opened vertical sliders 10, and, guided by the limiting ribs or vanes 22, is centrifuged in the predetermined sectors 24 against the damaged locations of the furnace wall FW.

If a complete renewal is to be undertaken, all of the vertical sliders 10 are opened according to the desired output load. If all of the vertical sliders 10 may be completely opened, then the slider guides 8 may be removed.

I claim:

1. Apparatus for hot repair of furnaces by precision centrifuging of refractory material against the damaged location of the lining of the furnace to be repaired, said apparatus comprising a centrifugal slinging machine having a generally horizontally disposed centrifuging wheel to which the refractory material is introduced from above, said centrifuging wheel having a central, upwardly opening chamber, means for dividing said chamber into radial sectors, individual and independently liftable and lowerable metering sliders for selectively and variably closing said sectors.

2. Apparatus according to claim 1, characterized in that the sliders are uniformly distributed around the periphery of the machine and means for individually and steplessly adjusting said sliders.

3. Apparatus according to claim 1, including radially directed vanes located radially outwardly of said sliders for guiding material centrifuged through said sliders.

4. Apparatus according to claim 1, characterized in that the sliders are of circular arc form when viewed in plan.

5. Apparatus set forth in claim 1 including a supply hopper located above said wheel and for delivering material thereto, a mixing worm located adjacent and in the lower portion of said hopper and above said wheel for mixing said material, and a vertically adjustable cone located in said hopper and having an upwardly converging taper for cooperating with said hopper for providing a variable annular clearance between said cone and the interior of said hopper.

6. Apparatus according to claim 1 including a supporting arm adjacent the upper end of said hopper, and an automatic clamping device for sliding said apparatus along said arm and for fixing said apparatus on said arm for swinging therewith.

7. Apparatus according to claim 6 further characterized in that said clamping device comprises a clevis hook having a pair of laterally spaced clamping parts pivoted thereto, said clamping parts each including a pair of vertically disposed pins, one on either side of said arm, whereby upward lifting of said clevis automatically causes said vertically spaced pins to clampingly engage against the opposite sides of said arm to provide a force locked connection therewith.

8. Apparatus for hot repair of furnaces by precision centrifuging of refractory material against the damaged location of the lining of the furnace to be repaired, said apparatus comprising a centrifugal slinging machine having a supply hopper, a generally horizontally disposed centrifuging wheel below said hopper and to which the refractory material is introduced from said hopper, a mixing worm located adjacent and in the lower portion of said hopper and above said wheel for mixing said material, a vertically adjustable cone located in said hopper and having an upwardly converging taper for cooperating with said hopper for providing a variable annular clearance between said cone and the interior of said hopper, said centrifuging wheel having a central, upwardly opening chamber, means for dividing said chamber into radial sectors, individual and independently vertically adjustable metering sliders for said sectors and for selectively and variably closing said sectors, and means for individually and steplessly adjusting said sliders.

9. Apparatus according to claim 8 further characterized in that said means for dividing said chamber includes radially directed vanes located radially outwardly of said sliders for guiding material centrifuged through said sliders.

10. Apparatus for hot repair of furnaces by precision centrifuging or refractory material against the damaged location of the lining of the furnace to be repaired, said apparatus comprising a centrifugal slinging machine having an upwardly diverging, frusto-conical supply hopper, a rotatably driven and vertically arranged drive shaft extending through the center of said hopper, a mixing worm located adjacent and in the lower portion of said hopper and fixed to said shaft for being rotatably driven thereby for mixing material delivered to said worm from said hopper, a generally horizontally disposed centrifuging wheel below said worm and to which the refractory material is delivered from said worm, said wheel also being fixed to and rotatably driven by said shaft, a vertically adjustable cone located in said hopper and on said shaft and having an upwardly converging taper for providing a variable annular clearance between said cone and the interior of said hopper as said cone is adjusted vertically in and respect to said hopper, said centrifuging wheel having a central and upwardly opening chamber for receiving mixed material from said worm, radial vanes for dividing said chamber into radial sectors, individual and independently vertically adjustable metering sliders for said sectors and for selectively and variably closing said sectors, and means for individually and steplessly adjusting said sliders.

11. Apparatus according to claim 10 including a supporting arm adjacent the upper end of said hopper, and an automatic clamping device for sliding said apparatus along said arm and for fixing said apparatus on said arm for swinging therewith.

12. Apparatus according to claim 11 further characterized in that said clamping device comprises a clevis hook having a pair of laterally spaced clamping parts pivoted thereto, said clamping parts each including a pair of vertically disposed pins, one on either side of said arm, whereby upward lifting of said clevis automatically causes said vertically spaced pins to clampingly engage against the opposite sides of said arm to provide a force locked connection therewith.

* * * * *